US005219165A

United States Patent [19]

Janes et al.

[11] Patent Number: 5,219,165

[45] Date of Patent: Jun. 15, 1993

[54] TENNIS RACQUET

[75] Inventors: Richard Janes, Scottsdale; William C. Douglas, Paradise Valley, both of Ariz.

[73] Assignee: GenCorp Inc., Fairlawn, Ohio

[21] Appl. No.: 814,954

[22] Filed: Dec. 30, 1991

[51] Int. Cl.[5] ..... A63B 49/02

[52] U.S. Cl. ..... 273/73 C; 273/73 G; 273/73 J

[58] Field of Search ..... 273/73 R, 73 A, 73 C, 273/73 D, 73 E, 73 F, 73 G, 73 H, 73 J, 73 K

[56] References Cited

U.S. PATENT DOCUMENTS

| | | | |
|---|---|---|---|
| 364,596 | 6/1887 | Luce | 273/73 C |
| 1,143,300 | 6/1915 | Moore | 273/73 G |
| 1,587,918 | 6/1926 | Morrison | 273/73 C X |
| 1,721,897 | 7/1929 | Cardwell | 273/73 C |
| 2,742,289 | 4/1956 | Allward . | |
| 3,690,658 | 9/1972 | Howe . | |
| 3,990,700 | 11/1976 | Robinson . | |
| 3,999,756 | 12/1976 | Head . | |
| 4,023,799 | 5/1977 | Van Auken | 273/73 C X |
| 4,052,060 | 10/1977 | Balkcom | 273/73 G X |
| 4,147,348 | 4/1979 | Lee | 273/73 C |
| 4,151,995 | 5/1979 | Weed . | |
| 4,184,679 | 1/1980 | Mishel . | |
| 4,196,901 | 4/1980 | Durbin | 273/73 G |
| 4,531,738 | 7/1985 | Mortvedt et al. . | |
| 4,561,655 | 12/1985 | Mortvedt | 273/73 J X |
| 4,575,082 | 3/1986 | Mott et al. | 273/73 G |
| 4,662,634 | 5/1987 | Winkler | 273/73 G |
| 4,746,119 | 5/1988 | Jeanrot | 273/73 G X |
| 4,828,260 | 5/1989 | Todd . | |
| 4,978,123 | 12/1990 | Ashihara | 273/73 J X |
| 5,071,124 | 12/1991 | Davis | 273/73 C X |

FOREIGN PATENT DOCUMENTS

| | | | |
|---|---|---|---|
| 2752624 | 5/1979 | Fed. Rep. of Germany | 273/75 |
| 3910871 | 10/1989 | Fed. Rep. of Germany | 273/73 G |
| 2201166 | 9/1987 | Japan | 273/73 R |
| 1278474 | 6/1972 | United Kingdom | 273/73 G |

OTHER PUBLICATIONS

"Omega 21 Design Aims at Control", *The Sporting Goods Dealer*, May, 1980, p. 122.

*Primary Examiner*—V. Millin
*Assistant Examiner*—William E. Stoll

[57] ABSTRACT

A tennis racquet comprising a continuous convex bow containing a plurality of interlaced strings attached under tension, and a handle formed integrally with the bow. The racquet is free of a yoke and a shaft and has a sweet spot located relatively closer to the distal end of the racquet. The racquet exhibits improved stiffness, bending moments and leverage in a racquet having a relatively large head size.

7 Claims, 6 Drawing Sheets

TENNIS RACQUET

FIELD OF THE INVENTION

The invention relates to tennis racquets, and in particular to a tennis racquet frame comprising a convex bow and a handle. More particularly, the invention relates to such a tennis racquet which is free of a yoke and a shaft, and which has a sweet spot located relatively closer to the distal end of the racquet.

BACKGROUND ART

Heretofore, a typical tennis racquet structure has included a bow and yoke collectively referred to as a head, a throat or shaft, and a handle. More specifically, the head has included an elliptical or circular bow containing attached, interlaced strings under tension. The bow conventionally has been attached to a handle through a variety of designs of throats or shafts, ranging from solid shafts to concave splayed, split shafts which typically are tangentially connected to the proximal-outer portions of the bow. The yoke usually has been located near the open proximal portion of the bow to form the lower portion of the head, extending between the inner surfaces of the bow at the transition from the convex bow to the concave shaft of the racquet frame. The yoke inhibits torsional movement of the bow by anchoring the proximal ends of the bow to each other. In addition to preventing torsional movement of the bow when a ball is struck, the yoke also has served to limit the proximal-to-distal string length which in turn inhibits trampolining which might otherwise occur if the yoke were not present and the strings were longer. Moreover, the yoke stabilizes the bow during stringing of the racquet.

However, despite such advantages, the presence of the yoke interrupts the flexion pattern of the bow. Causing the torsional movement of the bow to forceably come to such an abrupt end creates a sharply defined stress riser zone in the racquet at the junction of the bow and shaft. Thus, such shear forces which break up the bending modes as a result of yoke placement, at the least, cause unfavorable vibrations which are transmitted to the player's hand, and at worst can cause racquet failure.

Attempts have also been made to improve prior art tennis racquets through continuing advances in metal and composite technologies. These advances have made such materials the choice for most modern tennis racquet frames due to their ability to further improve the stiffness of the frame while reducing the weight thereof, resulting in improved power. However, this increased stiffness has resulted in a significant decrease in the duration of the shock impulse transmitted to the player's hand upon impact of a ball with the racquet strings, which effectively increases the strength of the jolt transmitted to the player's hand, which in turn adversely affects the playability of the racquet. Moreover, the increased height of the bow of many prior art racquets together with the use of such advanced composite materials, also adds to the stiffness of the bow, resulting in further increase in the shock felt by the player upon striking the ball. Thus, the trend in tennis racquet design toward increased stiffness and reduced weight has caused most racquet designers to search for a combination of design elements which maintain power, reduce shock and improve feel, through disposition of the sweet spot of the racquet to a more distal location, or in other words, closer to the general area of ball impact with the strings in most cases. The sweet spot generally is universally defined as being comprised of three separate elements, including, the area of highest coefficient of restitution of the racquet or the area of greatest power, the center of percussion of the racquet or the point at which the racquet will not twist or torque longitudinally or latitudinally, and nodal point or area of the strung face of the racquet where minimal vibration occurs upon ball impact.

However, the advent of racquets having generally larger heads has effectively proximally relocated the sweet spot, or in other words, reduced the distance of the sweet spot to the player's hand. This reduction in distance results in reduced leverage for the player, which especially effects longer and faster strokes, such as the service. One hallmark of the larger headed racquets is that the proximal end of the head lies closer to the handle area. It follows that the central portion of the head also is located closer to the handle. As a result, the three elements comprising the sweet spot all are located at or below the latitudinal center of the head, resulting in a loss of leverage for the player. To illustrate this point, a typical wood racquet circa 1960 has a longitudinal head length of 10.69 inches, while a large head racquet circa 1970 has a longitudinal head length of 13.25 inches. All other dimensions being equal, the center of the large head racquet is more than 1.25 inches closer to the player's hand than the small head wood racquet. Thus, the problem exists of disposing the sweet spot at a more distal location on the head while enjoying the advantages of a large headed racquet, such as greater tolerance on mishit shots.

U.S. Pat. No. 4,196,901 to Durbin is the closest known prior art, and relates to a tennis racquet comprising a frame providing an open, tensioned string receiving, playing head of generally elliptical configuration, and an elongated handle extending from the proximal end of the head along its longer axis and terminating in a hand grip, the configuration of the open head at the proximal end thereof being closed at a point between the center of gravity and the proximal end of said racquet. A preferred form of the racquet comprises a unitary frame bowed in its central portion to form a generally elliptical head configuration and continuing as coplanar throat and shaft extensions which are joined at their extremities in a hand grip, and the first joining of the ends being at a point between the center of gravity and the proximal end of the racquet. Central longitudinal strings may join the frame at points closer to the proximal end than is the center of gravity, and the longitudinal strings are under somewhat greater tension than the transverse strings. The racquet is characterized by reduced weight in the throat portion, resulting in the percussion center of the stringed area being advanced toward the distal end of the racquet, and the vibration level being reduced.

SUMMARY OF THE INVENTION

Objects of the invention include providing a tennis racquet having a sweet spot located relatively closer to the distal end of the head of the racquet.

Another object of the invention is to provide such a tennis racquet having improved stiffness due to a single convex beam or bow comprising the head of the racquet, which is directly attached to the handle of the racquet.

Still another object of the invention is to provide such a tennis racquet having a flex pattern which is more pleasant in feel during play, as a result of the bow tapering in width and increasing in height in the proximal-to-distal direction of the racquet.

A further object of the invention is to provide such a tennis racquet having a relatively large head size and strung area with suitable string tension, resulting in increased leverage by moving in a distal direction the area where the player achieves the best feel and power combination, so that accomplished players desiring greater leverage can obtain the same using the tennis racquet of the present invention.

Still a further object of the invention is to provide such a tennis racquet wherein the distance of the percussion center of the racquet from the player's hand toward the distal end of the racquet is increased, while at the same time reducing overall racquet weight.

Another object of the invention is to provide such a tennis racquet having reduced overall weight due in part to absence of a yoke in the racquet, while retaining the same swing weight values as conventional prior art racquets.

Still another object of the invention is to provide such a tennis racquet having a strung head area of increased longitudinal length, in order to enable strings exhibiting low values of percent elongation to be of desirable elasticity and resilience when used as a tennis racquet string.

A further object of the invention is to provide such a tennis racquet having a relatively long handle which improves the playability of the racquet for two-handed players.

A still further object of the present invention is to provide such a tennis racquet having improved power, feel, control, and overall playability.

Another object of the invention is to provide such a tennis racquet which is simple in design, lightweight and economical to manufacture.

These objects and advantages are obtained by the tennis racquet of the present invention, comprising, a continuous convex bow containing a plurality of interlaced strings attached under tension to the bow, and a handle integrally attached to the bow, the racquet being free of a yoke and a shaft.

BRIEF DESCRIPTION OF THE DRAWINGS

Similar numerals refer to similar parts throughout the drawings.

DETAILED DESCRIPTION OF THE INVENTION

Figure 1:
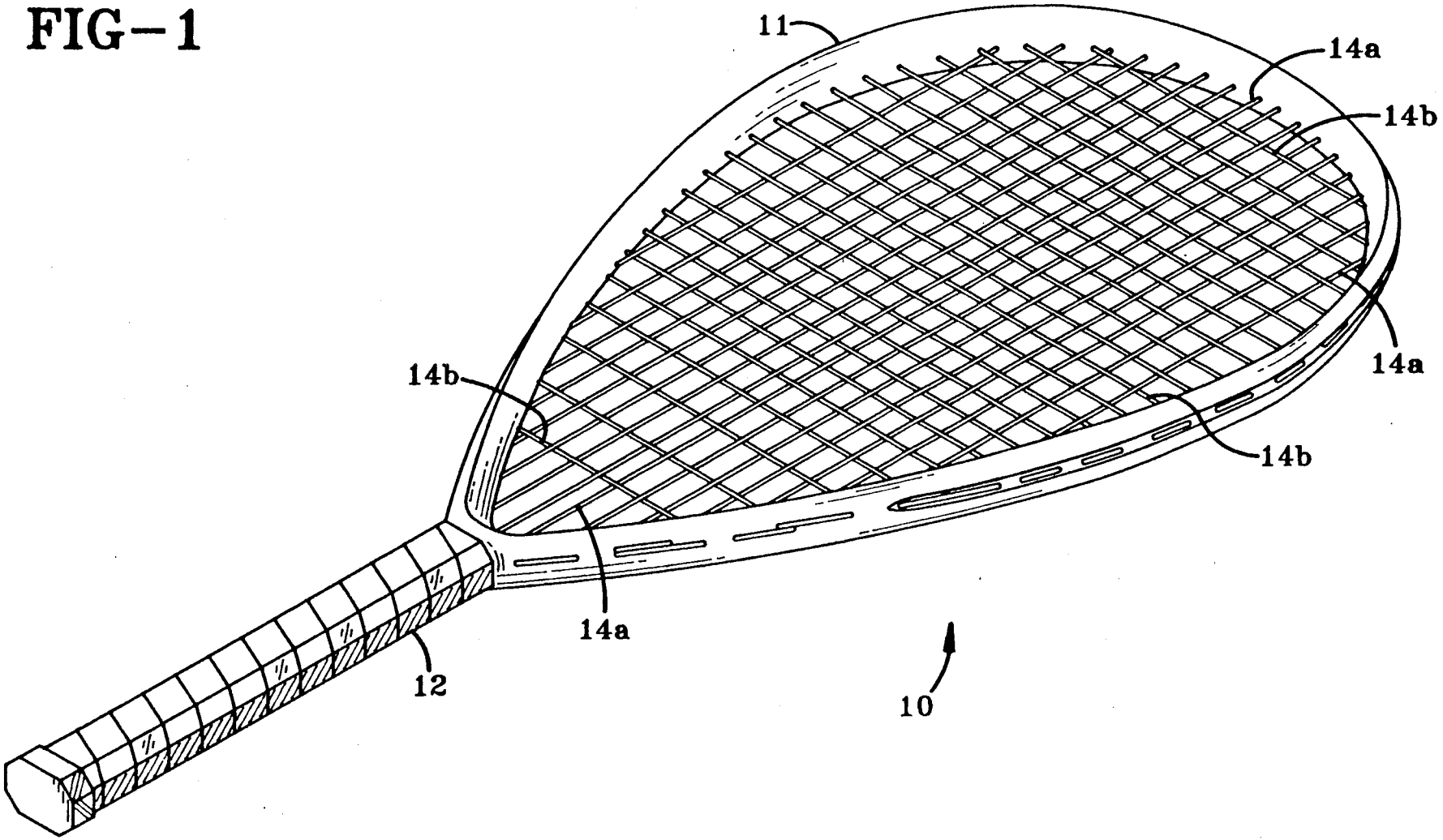
FIG. 1 is a perspective view of a first embodiment of the tennis racquet of the present invention.

A first embodiment of the tennis racquet of the present invention is indicated generally at 10 and is shown in FIG. 1. Tennis racquet 10 includes a head or bow 11 formed integrally with a handle 12. Racquet 10 can be fabricated from any suitable composite such as a glass fiber reinforced thermosetting plastic, or the like. In general, any material is suitable for fabricating racquet 10 so long as the desired physical characteristics of the racquet described in detail below can be obtained.

Figure 4:
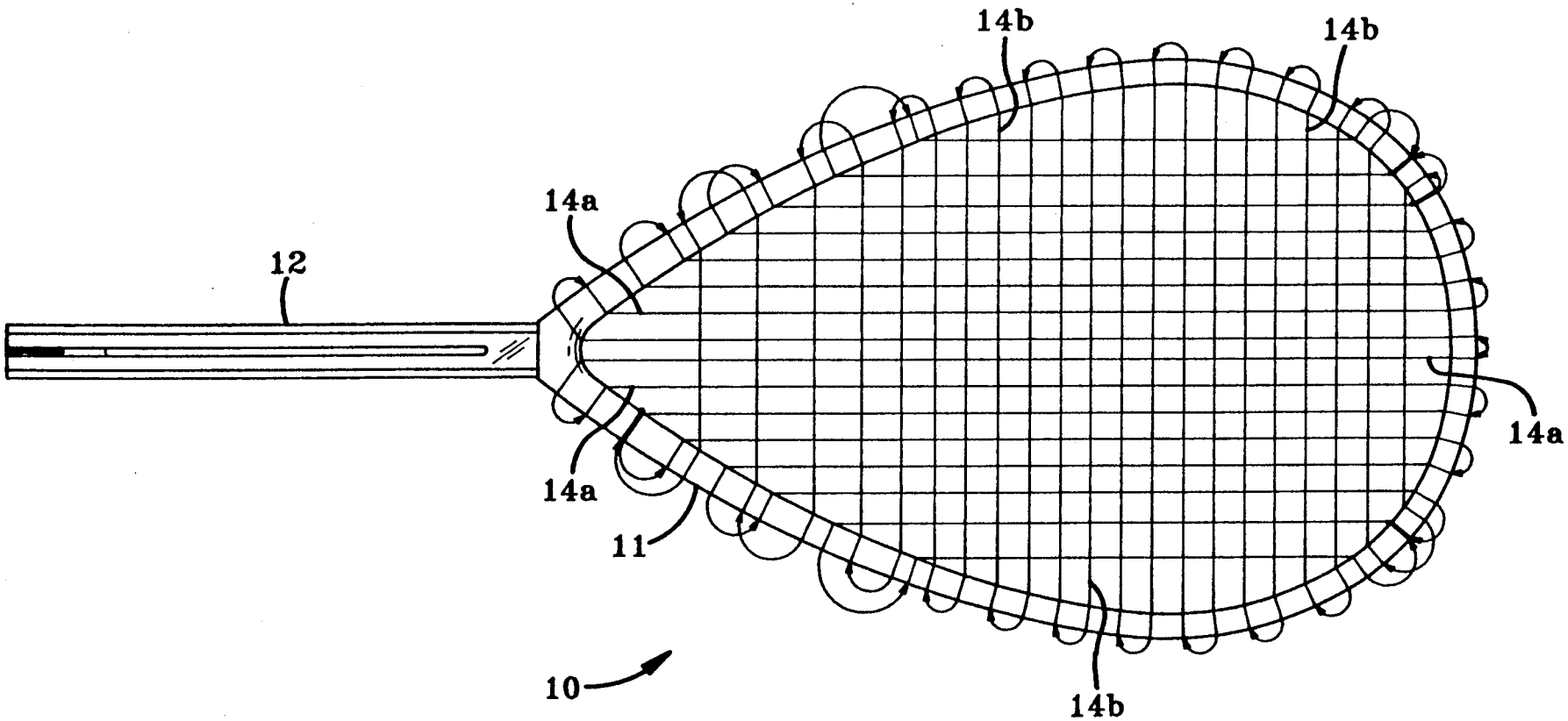
FIG. 4 is a view similar to FIG. 2, except showing the stringing configuration of the racquet.
Figure 5:
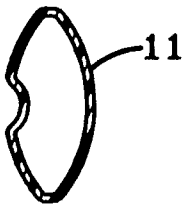
FIG. 5 is a sectional view of the bow taken on line 5—5, FIG. 2.
Figure 5A:
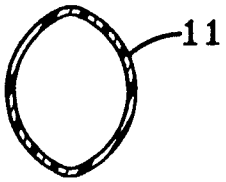
FIG. 5A is a sectional view of the bow taken on line 5A—5A, FIG. 2.
Figure 5B:
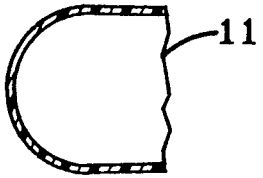
FIG. 5B is a sectional view of the bow taken on line 5B—5B, FIG. 2.
Figure 5C:
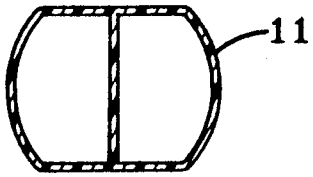
FIG. 5C is a sectional view of the bow taken on line 5C—5C, FIG. 2.
Figure 5D:
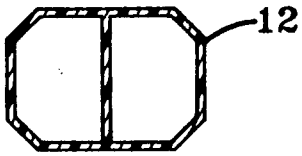
FIG. 5D is a sectional view of the handle taken on line 5D—5D, FIG. 2.
Figure 5E:
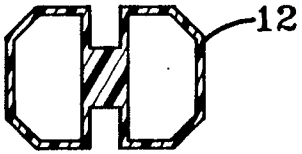
FIG. 5E is a sectional view of the handle taken on line 5E—5E, FIG. 2.
Figure 5F:
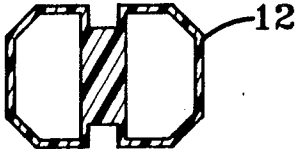
FIG. 5F is a sectional view of the handle taken on line 5F—5F, FIG. 2.
Figure 5G:
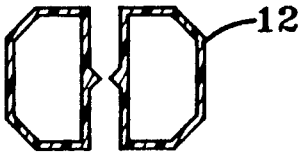
FIG. 5G is a sectional view of the handle taken on line 5G—5G, FIG. 2.

Racquet 10 includes a plurality of longitudinally and transversely extending strings **14*a* and 14*b*, respectively, contained within and securely attached to bow 11 in the manner shown in FIG. 4. Longitudinally extending strings 14*a* preferably have an elongation value of less than about 5 percent at 60 lbs. pull tension. Transversely extending strings 14*b* preferably have an elongation value of less than about 8 to about 12 percent at 60 lbs. pull tension. Suitable materials for longitudinally extending strings 14*a* include polyester and preferably aromatic polyamides such as those sold under the trademark "KEVLAR". Suitable materials for transversely extending strings 14*b* include nylon 66** and natural animal gut, with Nylon 66 being preferred. The pull tension of all strings of the racquet preferably is from about 50 to about 60 lbs. It has been found that the above parameters minimize trampolining of the strings. Trampolining is the result of too much elasticity in the strings caused either by strings that are too long or by too little tension in the strings, which in turn results in loss of control of ball speed and direction.

In accordance with one of the main features of the present invention, bow 11 is entirely convex and continuous and is formed integrally with handle 12. This structure is antipodal to known conventional tennis racquets, which include a yoke forming the proximal portion of the head adjacent to a concave throat or shaft which connects the handle to the bow of the head. As shown in FIGS. 3,5, 5A, 5B, and 5C, the cross-sectional configuration of bow 11 is variable to support the varying forces to which the racquet is subjected during play. More particularly, in moving from the proximal end of bow 11 at FIG. 5B to the distal end of the bow at FIG. 5, the width of the bow clearly tapers and the height increases. The absence of a yoke saves approximately 2 ounces in weight without affecting the overall stiffness of racquet 10 due to the variable cross section of bow 11. Moreover, the mass associated with the yoke can be partially returned to bow 11 in various areas to improve longitudinal or transverse inertia for increasing stability in light of the lessened weight. In addition, absence of a yoke allows the bending mode or moment of the bow to occur naturally during play whereby the tennis player experiences a pleasant feel with low vibration to the hand during impact of the strung racquet face with a tennis ball.

In contrast, the yoke of known prior art tennis racquets, as well as the throat or shaft, generally stops the rotation of the bow resulting in a shear point which decreases durability as well as creating an interruption in the bending mode, which imparts an unpleasant feel or vibration to the hand of the player during ball impact. Since the tennis racquet of the present invention does not utilize a convex bow connected to the handle through a transitional concave shaft, weakness at the convex-concave transition is avoided. Thus, a yoke is unnecessary to control the tremendous twisting which occurs due to such a convex-concave structure.

Again, the present invention results in improved durability and playability without the yoke due to the convex-only design of bow 11 coupled with the variable cross section of the bow. Exclusive use of a convex bow 11 in racquet 10 without a concave shaft results in a more even flow of flex or longer bending moment during and after impact with a ball, since the arc of the bow is unchanged and the bow will flex or rotate only in a single direction. Known prior art tennis racquets incorporating the conventional convex-concave design typically have the convex bow rotating in one direction and the concave shaft rotating in an opposite direction upon and after impacting a ball, thereby creating a shear point which has been observed in laboratory and field tests as well as via finite element analysis. In contrast, the convex-only variable cross-section bow of racquet 10 of the present invention, results in a stronger supportive bow il which rotates only slightly in a single direction during and after impacting a ball for good feel, and in particular results in a bow exhibiting good strength characteristics in its distal portions. Such strength is necessary to resist the strong internal-seeking forces associated with the string tensions acting upon bow 11 of racquet 10, which can approach 2,000 lbs.

Figure 2:
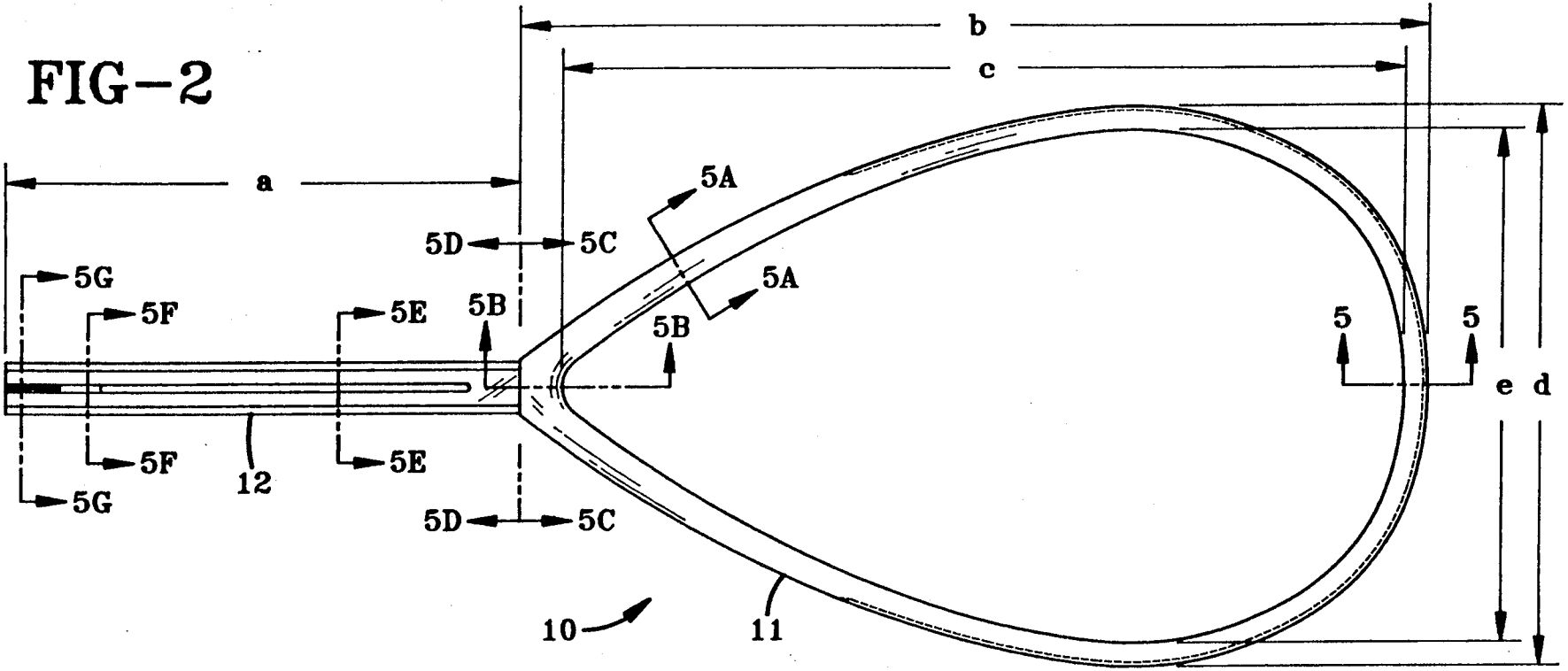
FIG. 2 is an elevational view of the playing surface of the tennis racquet of FIG. 1, shown without strings and a handle grip.
Figure 3:
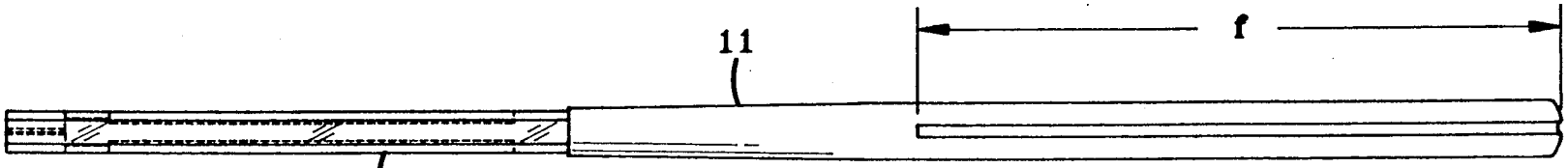
FIG. 3 is an elevational side view of the racquet of FIG. 2.

In accordance with another of the important features of the present invention, bow 11 of tennis racquet 10 of the present invention is relatively long combined with a normal width, as illustrated especially in FIG. 2. More particularly, the length of bow 11 of the first embodiment of racquet 10 is 422 mm or 16.6 inches as indicated by distance c in FIG. 2, and its width is 259 mm or 10.19 inches as indicated by distance e in FIG. 2, resulting in a head size strung area of approximately 121 square inches. The ratio of the width of bow 11 to the length of the bow in racquet 10, is 0.62, or distances d to b as shown in FIG. 2, is 0.62, while those of conventional prior art tennis racquets generally is 0.75 to 0.76. It should be noted that distance f in FIG. 3 has a value of 295 mm.

Handle 12 generally is conventional in shape as shown in FIGS. 1–3 and 5D–5G. However, due to the unique design of racquet 10 of the invention, whereby the racquet lacks a shaft and yoke, handle 12 can be made longer, which results in improved playability of the racquet for two-handed players. As shown in FIG. 2, the length of handle 12 is represented as distance a or 257 mm.

In accordance with still another of the features of the present invention, the sweet spot of tennis racquet 10 of the present invention (not shown) is located relatively closer to the distal end of bow 11 on strings 14. In actuality, the general sweet spot is comprised of three discrete elements, as previously described herein. As also discussed hereinabove, movement of the sweet spot relatively closer to the distal end of the racquet improves leverage for the tennis player. More particularly, leverage is directly proportional to the distance from the proximal end of handle 12 to the sweet spot. The greater this distance, the greater leverage experienced by the tennis player.

More specifically, the first discrete element which contributes to the overall sweet spot is the nodal point (not shown), which is the area of strings 14 where minimal vibration occurs during ball impact.

The second discrete sweet spot element is the point of highest coefficient of restitution (not shown) or area of greatest power on the strung surface of racquet 10. The point of coefficient of restitution (hereinafter COR) is the area where the greatest support of bow 11 occurs and is usually located in the proximal end of bow 11. In general, the closer the COR is to the proximal end of bow 11, the weaker the COR will be in the distal nodal areas of the bow, which in turn results in weakness in the distal areas of the bow of racquet 10. Bow 11 of racquet 10 of the present invention increases the COR in the distal area of bow 11 by supporting the distal bow area as strongly as possible through elimination of the convex-concave bends found in prior art tennis racquet frames. That is, by directly connecting convex bow 11 to handle 12, the distal bow support is strengthened and resistance to twist due to off-center hits is greatly increased which results in greater power or COR in the distal bow area.

The third discrete sweet spot element is the point of center of percussion (not shown and hereafter referred to as CP), which is the point at which racquet 10 will not twist or torque longitudinally or transversely. It is understood that CP can be easily moved by adjusting the location of mass in the racquet frame. For example, absence of weight from the area of center of gravity of the racquet by absence of the yoke and distribution of the mass thereof around bow 11 as has been accomplished in racquet 10 of the present invention, causes the CP to move toward the distal end of the racquet. This results in improved strength in racquet 10, thus lowering the likelihood that the handle will be apt to twist or jump out of a player's hand upon impact with a ball. Stated another way, as CP approaches the distal end of the racquet, racquet rotation on impact is decreased resulting in a more pleasant feel. Thus, although the CP heretofore has generally resided in the proximal head area of a racquet, it can be moved distally by transferring racquet mass from the central area of the racquet to the distal end of the bow as by absence of the yoke and increase in the mass of bow 11 of racquet 10 of the present invention.

As shown in FIGS. 3 through 5C, another manner in which power is added to the distal area of bow 11 of racquet 10 is to increase the height of the bow in the distal bow area. Increasing the height in moving from the proximal bow area to the distal bow area reduces vibration and shock enabling bow 11 to gradually flex more as it approaches the handle area. In addition, the width of bow 11 tapers from wider in the proximal area of the bow to thinner in the distal area. Thus, the use of a wider but lower bow in the proximal end of bow 11 which tapers to a thinner but higher bow in the distal end controls the flex pattern and increases resistance to torque. Such controlled flex gives a solid feel to the tennis racquet without the sudden jolt of an off-center ball impact. This controlled perimeter three-dimensional taper design is extremely desirable due to the increased lay-up accuracy associated with a constant perimeter geometry.

The power zone of racquet 10 of the present invention substantially covers the entire strung surface of the racquet, and is moved relatively closer to the distal end of the racquet due to the absence of a yoke and redistribution of yoke mass in bow 11, and further due to the single convex tapered configuration of the bow. A power zone is defined as the strung area which shows a coefficient of restitution greater than 0.35.

Figure 6:
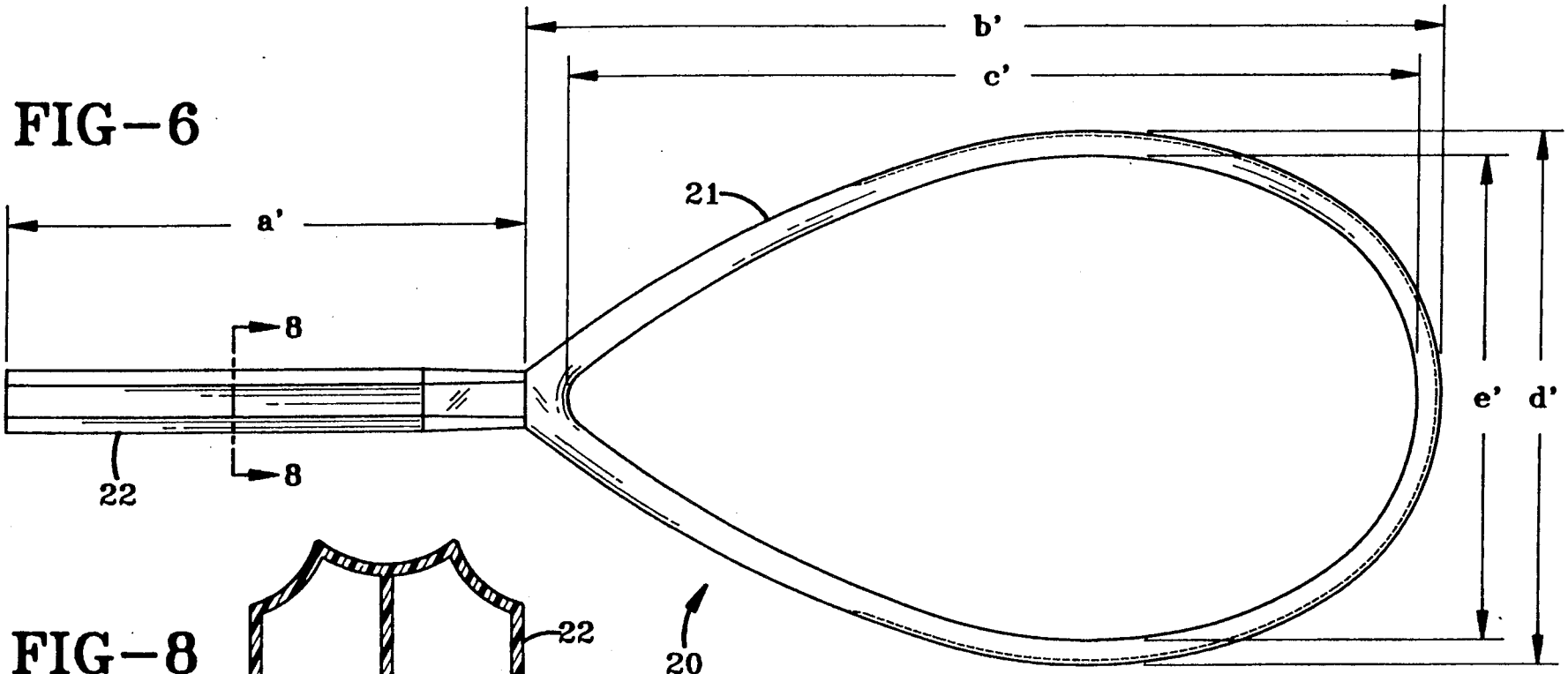
FIG. 6 is an elevational view of the playing surface of a second embodiment of the tennis racquet of the present invention, shown without strings and a handle grip.
Figure 8:
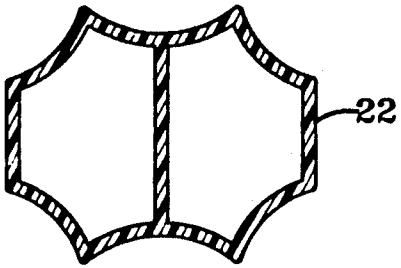
FIG. 8 is a sectional view of the handle taken on line 8—8, FIG. 6.
Figure 7:
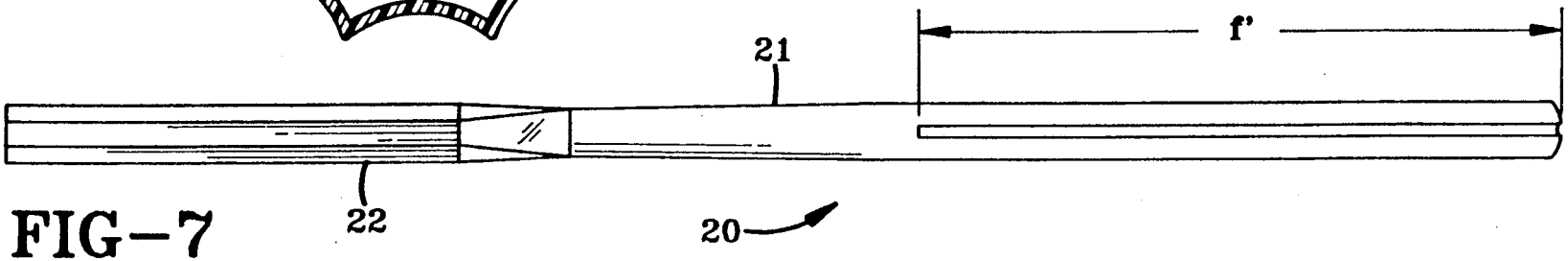
FIG. 7 is an elevational side view of the racquet of FIG. 6.

A second embodiment of the tennis racquet of the present invention is indicated generally at 20 and is shown in FIGS. 6–8. Tennis racquet 20 includes a head or bow 21 formed integrally with a handle 22. Racquet 20 is similar to racquet 10 in most respects, except that the inside and outside widths of bow 21 of racquet 20 are less than those of bow 11 of racquet 10. Specifically, the inside and outside widths of bow 21 are represented by e' and d' in FIG. 6, respectively, and have values of 243.16 mm and 267.78 mm. Moreover, handle 22 differs from handle 12 of racquet 10 in its cross-sectional design as shown in FIG. 8. Handle 22 is lighter than most conventional tennis racquet handles, yet still exhibits suitable shock absorbing and indexing properties. This lightweight feature of handle 22 serves to move the percussion center of racquet 20 even further distally. Handle 22 is more fully described in U.S. patent application Ser. No. 07/815,109, filed on the same day and assigned to the same assignee as the instant application, and is hereby fully incorporated by reference herein.

Figure 9:
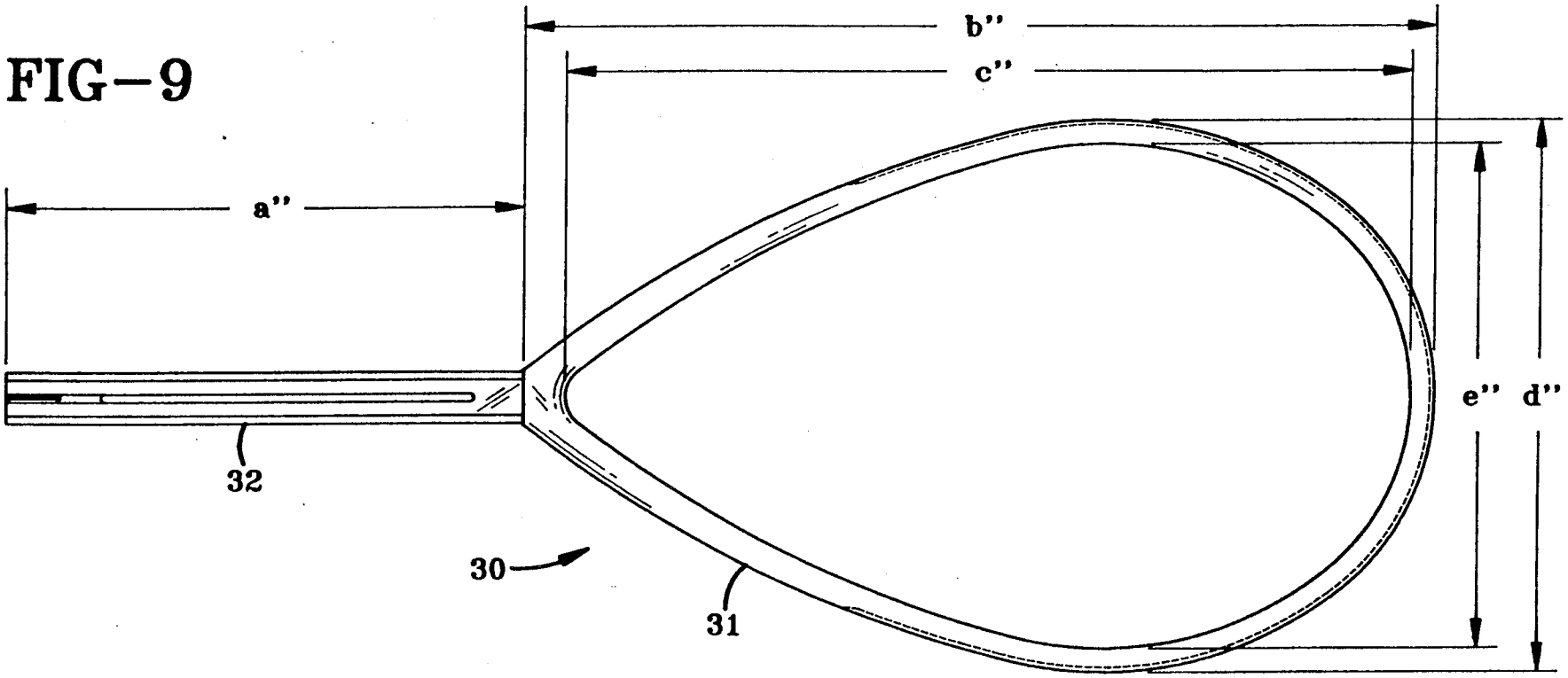
FIG. 9 is an elevational view of the playing surface of a third embodiment of the tennis racquet of the present invention, shown without strings and a handle grip.
Figure 10:
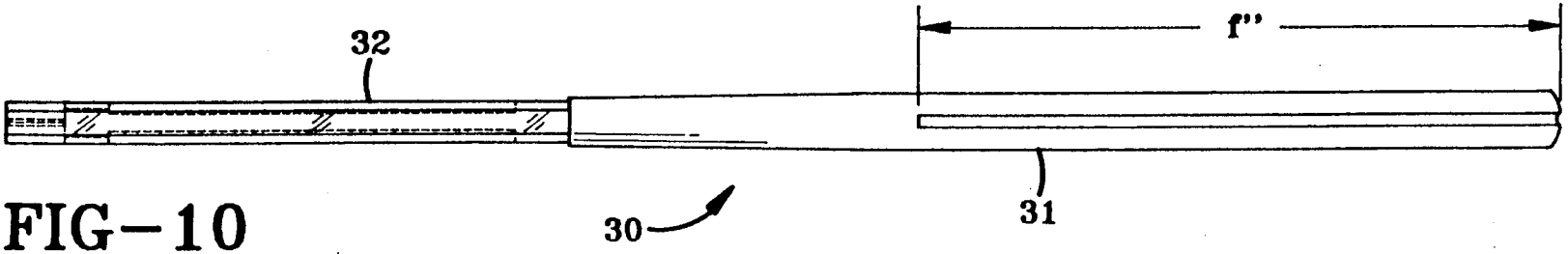
FIG. 10 is an elevational side view of the racquet of FIG. 9.

A third embodiment of the present invention is indicated generally at 30 and is shown in FIGS. 9 and 10. Racquet 30 includes a bow 31 formed integrally with a handle 32, and is similar to racquet 10 in most respects except that the inside and outside widths of bow 31 of racquet 30 are slightly less than those of bow 11 of racquet 10. Specifically, the inside and outside widths of bow 31 are represented by e'' and d'' in FIG. 9, respectively, and have values of 254.23 mm and 278.23 mm.

In summary, the tennis racquet of the present invention has a sweet spot located relatively closer to the distal end of the head of the racquet due to the absence of a yoke and a shaft from the racquet design. This distal movement of the sweet spot results in greater leverage for the tennis player than would be possible using other racquets having similar head sizes. The design features accomplishing distal movement of the sweet spot result in a tennis racquet having improved power, feel, control and overall playability. The absence of a yoke allows the bending moment of the bow to occur naturally during play, whereby the tennis player experiences a pleasant feel with low vibration to the hand during impact of the strung racquet face with a tennis ball. The improved durability and playability of the racquet despite the absence of a yoke is attributable to the convex-only design of the bow coupled with the variable cross-section of the bow. Absence of a concave shaft results in a more even flow of flex or a longer bending moment during and after impact with a ball.

While in accordance with the Patent Statutes, the best mode and preferred embodiments have been set forth, the scope of the invention is not limited thereto, but rather by the scope of the attached claims.

We claim:

1. A tennis racquet comprising a stringed bow portion defining a string area having an inner periphery which is continuously concave along the length of said bow when viewed from inside the bow, said bow including a base portion to which an elongated handle having a substantially uniform axial cross section immediately adjacent the bow is directly attached, the entire outer periphery of the portion of the bow extending from said base portion and said handle being continuously convex when viewed along a line perpendicular to the string area, the longitudinal axis of said elongated handle being coincident with the major longitudinal axis of said bow, said racquet being yoke free, the cross section of said bow having a width defined by the distance between the inner and outer periphery of said bow and a height dimension perpendicular to said width, the cross section of said bow being higher and narrower moving from said base portion to the portion opposite said base portion.

2. The racquet of claim 1, wherein the ratio of the width to the length of said bow as measured at its widest and longest points is about 0.62; and wherein the area of strung surface of said racquet is about 121 square inches.

3. The racquet of claim 1, wherein the ratio of the width to the length of said bow as measured at its widest and longest points is about 0.59; and wherein the area of strung surface of said racquet is about 113 square inches.

4. The racquet of claim 1, wherein the ratio of the width to the length of said bow as measured at its widest and longest points is about 0.61; and wherein the area of strung surface of said racquet is about 118 square inches.

5. The racquet of claim 2, wherein said bow is formed of a composite material.

6. The racquet of claim 5, wherein said interlaced strings include longitudinally and transversely extending strings; and wherein said longitudinally extending strings are formed of an aromatic polyamide fiber and have an elongation value of less than about 5 percent at 60 lbs pull tension, and said transversely extending strings are formed of nylon 66 and have an elongation value of less than about 8 percent to about 12 percent at 60 lbs pull tension.

7. A tennis racquet comprising a stringed bow portion having an inner peripheral length which is continuously concave when viewed from inside the bow, said bow portion having a generally ovate shape with a relatively small radius of curvature defining the basal end of said bow and a larger radius of curvature at the opposite end defining the vertex end of said bow, said ovate shape defining a string area, a handle portion having a substantial uniform axial cross section immediately adjacent the bow directly attached at one end to the outer periphery of said bow portion at said basal end, the longitudinal axis of said elongated handle being coincident with the major longitudinal axis of said bow, said bow portion when viewed along a line perpendicular to the string area being continuously convex along its outer peripheral length extending away from the junction between said handle portion and said bow portion, the cross section of said bow portion having a width defined by the distance between the inner and outer periphery of said bow and a height dimension perpendicular to said width, the cross section of said bow becoming narrower in width and having increasing height moving from the basal end towards the vertex of said bow, said racquet being free of a yoke and a shaft.

* * * * *